US006760956B1

(12) United States Patent
Lee et al.

(10) Patent No.: US 6,760,956 B1
(45) Date of Patent: Jul. 13, 2004

(54) PUTTER TOWEL CLIP

(75) Inventors: Edmond Ken Lee, 6904 Villagewood Way, San Jose, CA (US) 95120; Barry Kitazumi, Milpitas, CA (US)

(73) Assignee: Edmond Ken Lee, San Jose, CA (US)

( * ) Notice: Subject to any disclaimer, the term of this patent is extended or adjusted under 35 U.S.C. 154(b) by 3 days.

(21) Appl. No.: 10/091,930

(22) Filed: Mar. 5, 2002

(51) Int. Cl.[7] ..... A45F 5/00

(52) U.S. Cl. ..... 24/3.12; 24/336; 24/303; 248/229.2; 224/932

(58) Field of Search ..... 24/3.2, 3.12, 303, 24/7, 570, 461, 459, 462, 336, 337, 340, 346; 224/932, 269, 918; 248/214, 215, 229.17, 229.2, 229.26, 218.4

(56) References Cited

U.S. PATENT DOCUMENTS

| | | | | | |
|---|---|---|---|---|---|
| 194,306 | A | | 8/1877 | Marshall et al. | |
| 853,544 | A | | 5/1907 | Fernald | |
| 2,152,897 | A | | 4/1939 | Madore | |
| 2,526,985 | A | | 10/1950 | Whitehead | 150/1.5 |
| 2,532,195 | A | | 11/1950 | Rosenow et al. | 150/1.5 |
| 2,589,126 | A | | 3/1952 | Payne | |
| 2,738,113 | A | | 3/1956 | Sigler | |
| 2,913,789 | A | | 11/1959 | Loredo | |
| 3,085,777 | A | | 4/1963 | Lewtan et al. | |
| 3,100,324 | A | * | 8/1963 | Tutino | 24/346 |
| 3,577,583 | A | | 5/1971 | Amann | 16/87.2 |
| 3,756,550 | A | | 9/1973 | Kollitz | 248/206 A |
| 3,831,652 | A | | 8/1974 | Hyden et al. | 150/52 G |
| 3,861,434 | A | | 1/1975 | Harding | 150/52 G |
| 3,938,570 | A | | 2/1976 | Stewart | 150/52 G |
| 4,100,652 | A | | 7/1978 | Carlson | 24/3 R |
| 4,121,798 | A | * | 10/1978 | Schumacher et al. | 248/113 |
| 4,736,877 | A | | 4/1988 | Clark | 224/252 |
| 4,802,265 | A | * | 2/1989 | Stevenson | |
| 4,878,276 | A | | 11/1989 | Morrish et al. | 24/511 |
| D306,056 | S | | 2/1990 | Tucker | D21/234 |
| 4,901,406 | A | | 2/1990 | Shelby et al. | 24/521 |
| 4,915,279 | A | | 4/1990 | Galbraith | 224/230 |
| 4,993,126 | A | * | 2/1991 | Collins | 24/336 |
| 5,046,222 | A | * | 9/1991 | Byers et al. | 24/343 |
| 5,143,371 | A | | 9/1992 | Strahan | 273/32 B |
| 5,284,194 | A | | 2/1994 | Gaffney | 150/160 |
| 5,318,292 | A | | 6/1994 | De Marco | 273/32 B |
| D348,712 | S | | 7/1994 | Parker, Jr. | D21/223 |
| 5,331,725 | A | | 7/1994 | Chou | 24/545 |
| 5,332,090 | A | | 7/1994 | Tucker | 206/315.3 |
| D361,506 | S | | 8/1995 | Rumpel | D8/395 |
| 5,437,449 | A | | 8/1995 | Zink | 273/32 B |
| 5,441,224 | A | | 8/1995 | Ludwig | 248/74.2 |
| 5,460,346 | A | | 10/1995 | Hirsch | 248/229.13 |
| 5,470,067 | A | | 11/1995 | Diresta | 273/57.2 |
| D364,912 | S | | 12/1995 | Sowers | D21/234 |
| 5,553,345 | A | | 9/1996 | Bell | 15/209.1 |
| D375,453 | S | | 11/1996 | Fleck | D8/395 |
| D380,145 | S | | 6/1997 | Rumpel | D8/395 |
| 5,647,568 | A | | 7/1997 | Nettles | 248/316.2 |
| 5,671,515 | A | | 9/1997 | Evans | 24/615 |
| 5,769,141 | A | | 6/1998 | Rinehard | 150/160 |
| D398,688 | S | | 9/1998 | Hsu et al. | D21/223 |
| 5,799,853 | A | | 9/1998 | Brewster | 224/679 |
| 5,820,095 | A | | 10/1998 | Stone | 248/316.7 |
| 5,820,476 | A | | 10/1998 | Amato | 473/217 |
| 5,820,479 | A | | 10/1998 | Cline et al. | 473/282 |

(List continued on next page.)

*Primary Examiner*—Robert J. Sandy
(74) *Attorney, Agent, or Firm*—Bingham McCutchen LLP; Fabio E. Marino; Gerald Chan

(57) ABSTRACT

A clip used to attach a towel to a golf club, (e.g., a putter). The clip has an opening to attach to the golf club, and an opening to attach to the towel. The clip may be mechanically attached to the club, or may use magnets. The towel may be permanently attached to the clip or may be removable. Methods for attaching a towel to a golf club and manufacturing the clip are also provided.

12 Claims, 7 Drawing Sheets

U.S. PATENT DOCUMENTS

| | | | | | |
|---|---|---|---|---|---|
| D401,296 | S | | 11/1998 | Cole et al. | D21/234 |
| 5,884,372 | A | * | 3/1999 | Anscher et al. | 24/339 |
| 5,941,487 | A | | 8/1999 | Keely | 248/231.51 |
| 6,062,521 | A | * | 5/2000 | Kelley et al. | 248/339 |
| 6,176,792 | B1 | | 1/2001 | Tate | 473/286 |
| 6,189,187 | B1 | * | 2/2001 | Williams | 24/563 |
| 6,270,424 | B1 | | 8/2001 | Holub | 473/286 |
| 6,383,088 | B1 | * | 5/2002 | Kershner | 473/282 |
| 2001/0037542 | A1 | | 11/2001 | Elliott | 24/3.11 |

* cited by examiner

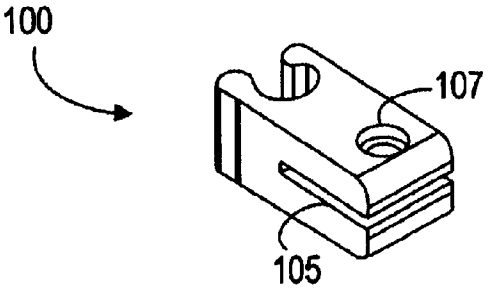
Fig. 1A
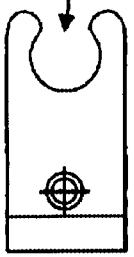
Fig. 1D
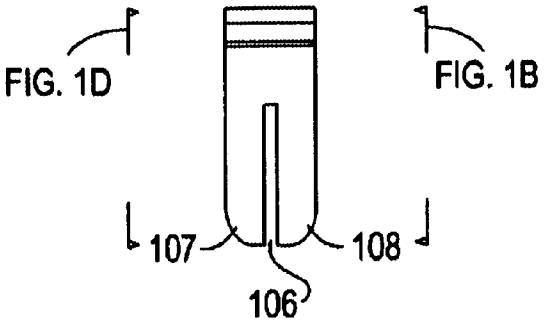
Fig. 1C
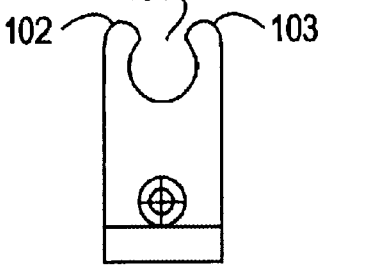
Fig. 1B
FIGURE 1

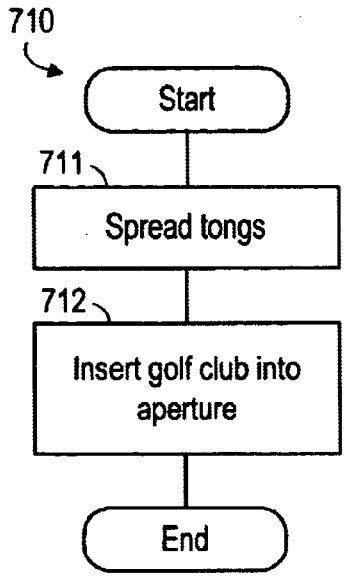
FIGURE 7A
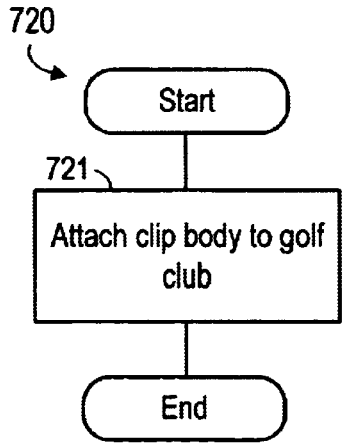
FIGURE 7B
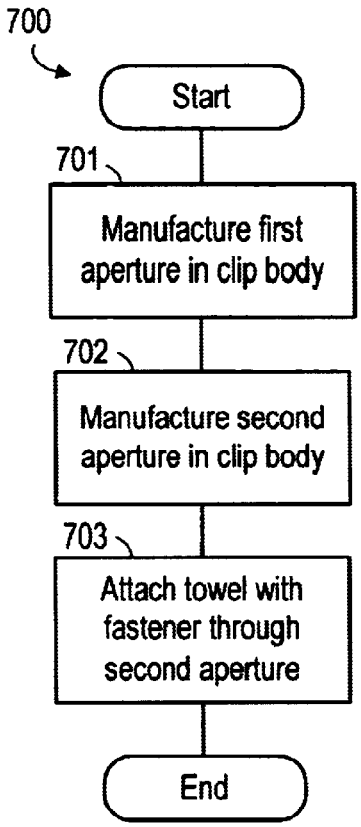
FIGURE 7C
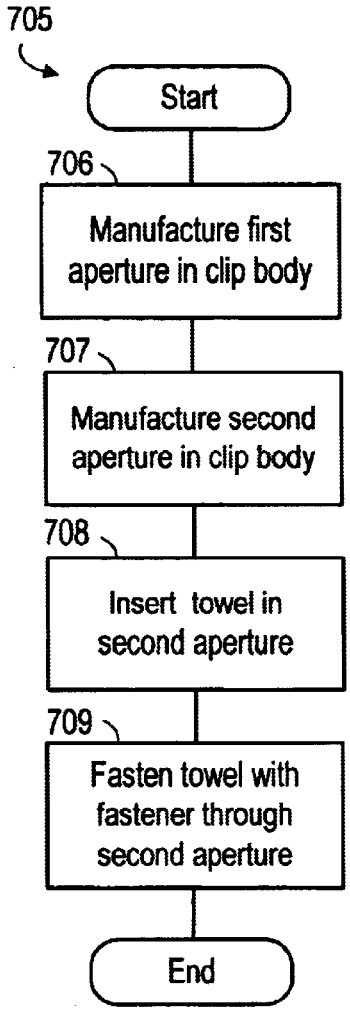
FIGURE 7D
FIGURE 7

PUTTER TOWEL CLIP

FIELD OF THE INVENTION

The invention relates generally to golf accessories and, more particularly, to a clip for attaching a towel to a golf club.

BACKGROUND

Golf is played outdoors in various weather and environmental conditions. Golf equipment and golf balls generally get dirty from grass, dirt, mud, sand, and other environmental agents.

Many golfers carry a towel that is removably secured to a golf bag to wipe golf balls and clubs from time to time, as well as their hands in the event they become muddy or wet from perspiration. Over time, carrying a towel may become burdensome and golfers therefore tend to leave towels fastened to their bags, golf carts and the like.

As is known, golf carts and other wheeled devices are forbidden to travel on the greens of most, if not all, golf courses. As a result, any golfer who is not carrying a towel on his or her person is likely to leave the towel in the cart on a nearby cart path, or in his/her golf bag, and then walk onto the green before realizing that he or she needs to wipe the ball. Examples of conditions making it important to clean the ball are wet greens, wet sand in traps, fertilizer on the greens, and other conditions as listed above. As is also known, when the ball is on the putting green it is permissible to use a ball marker to spot where the ball lies, lift the ball, and then proceed to wipe the ball before putting. It is important to clean the ball before putting for, if the golf ball is not clean, the trajectory of the ball may be affected. If the towel has been left on the cart, however, any convenient item of clothing or even putting the ball to the mouth becomes the means by which most golfers proceed to clean their balls, for to return to the cart or golf bag for the towel would require extra effort and delay the game. In some situations, golfers may even lick the ball or stick the ball in their mouth or spit on the ball, then wipe the ball on their shirt or pants to clean the ball.

SUMMARY

The present invention addresses the foregoing problems by providing a clip to attach a towel to a golf club. As a result, golfers using a clip in accordance to the present invention are able to clean balls with the attached towel before putting. The clip has an aperture to receive the golf club and another aperture to receive a towel. The clip may also utilize a fastener for fastening the towel to the clip.

BRIEF DESCRIPTION OF THE DRAWINGS

FIGS. 1A–D provide sketch views of a clip, in accordance with some embodiments of the present invention, where the aperture for the towel is approximately perpendicular to the axis of the aperture which receives the golf club.

FIGS. 7A–D are flow diagrams of methods to attach a clip to a golf club, and to manufacture a clip for attaching a towel to a golf club, in accordance with some embodiments of the present invention.

DETAILED DESCRIPTION

Figure 2:
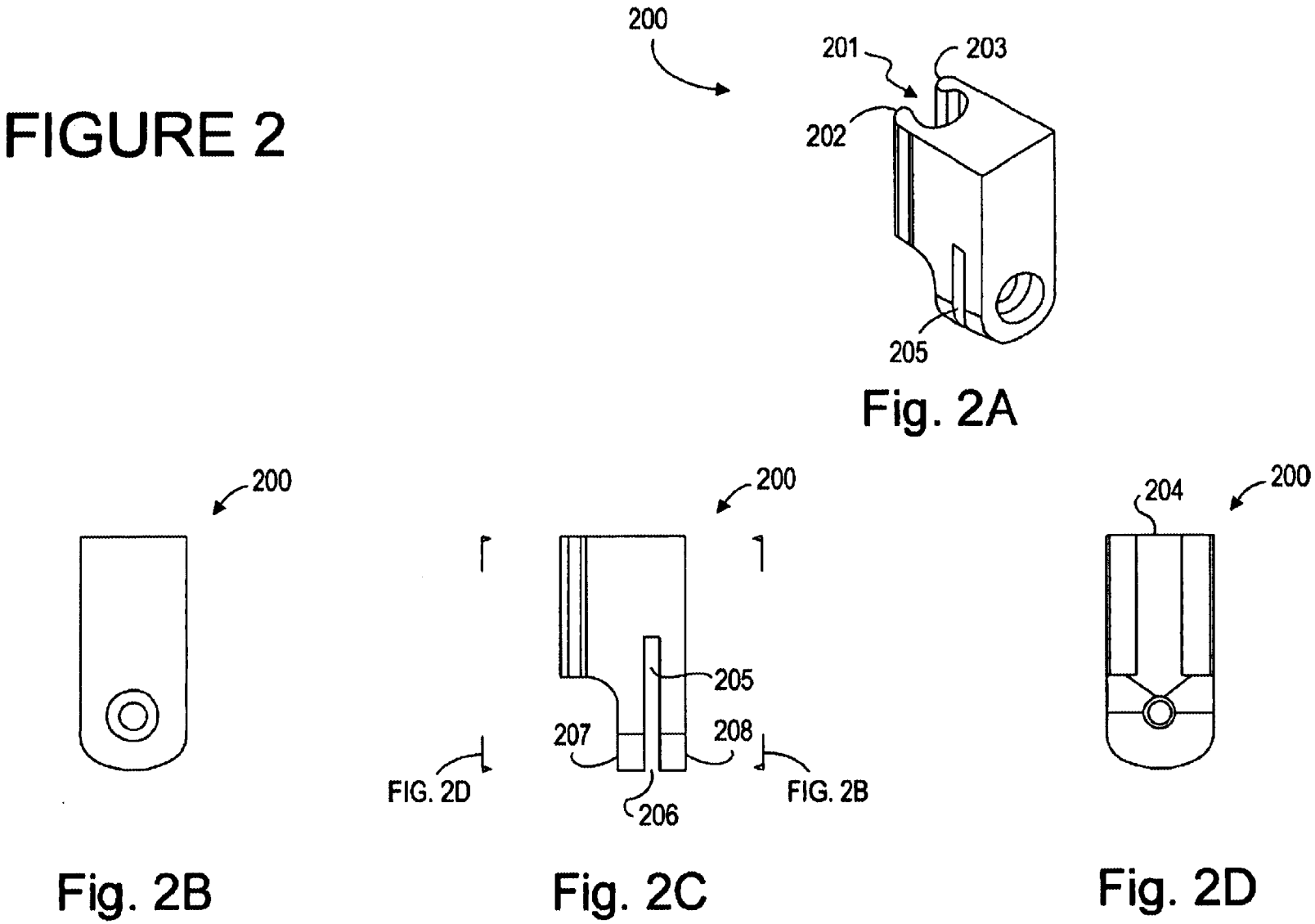
FIGS. 2A–D provide sketch views of a clip, in accordance with some embodiments of the present invention, in which the aperture adapted to receive the towel is approximately parallel to the aperture adapted to receive the golf club.

Referring to FIG. 1A, a clip 100 is shown in perspective. In some embodiments, as shown in FIGS. 1A–D, clip 100 is designed such that the axis of interior chamber 101 is approximately perpendicular to the plane of aperture 105. Clip 100 has an integral structure and is made of a reasonably tough, resilient elastomeric material. In some embodiments, clip 100 may be made of plastic, metal, ceramic, or other materials. Clip 100 has sufficient rigidity to maintain its shape but sufficient resiliency to flex enough for its intended function, as detailed below. Clip 100 has two arms 102 and 103 joined together at one end and spaced apart at the other end to define an opening 104. Together arms 102 and 103 enclose an interior chamber 101. Clip 100 is designed to receive and hold in place in chamber 101 a member (not shown). The member may be cylindrical. A variety of members could be used in accordance to the principles of the invention. The member may be, for example, a solid rod or the shaft of a golf club.

The body of clip 100 may be molded or otherwise formed or manufactured to define an interior chamber 101, shaped substantially as shown in FIG. 1A. In some embodiments, clip Lit. 100 may be machined or may be injection molded. The dimensions of various portions of chamber 101 will be determined by the diameter of the members for which they are intended. The diameter of the cylindrical members desired to be held by clip 100 in any given embodiment is selected to fit that particular diameter. In some embodiments, clip 100 may be designed such that it holds the member snugly so as not to slide along the member. In some embodiments, the taper of the club shaft will prevent clip 100 from sliding along the shaft.

In some embodiments, the width of opening 104 when clip 100 is in an unflexed state is selected to be smaller than the diameter of the member to be held. In order to allow the member to enter chamber 101, arms 102 and 103 flex outwardly. The elasticity of the material of the clip resists this localized flexing. In some embodiments, a magnet may be embedded in clip 100 proximate to chamber 101 such that the magnet attaches the clip to magnetic members placed in chamber 101.

In addition, clip 100 has an aperture 105. In some embodiments, the plane of aperture 105 is approximately perpendicular to the axis of opening 101. Aperture 105 has an opening 106, which may receive substantially planar items such as a towel (not shown). The planar item, such as a towel, may be inserted into opening 106 with or without the flexure of arms 107 and 108.

In some embodiments, as shown in FIGS. 2A–D, clip 200 is designed such that the axis of interior chamber 201 is approximately parallel to the plane of aperture 205. In some embodiments, the width of opening 204 when clip 200 is in an unflexed state is selected to be smaller than the diameter of the member to be held. In order to allow the member to enter chamber 201, arms 202 and 203 flex outwardly. The elasticity of the material of the clip resists this localized flexing. In other embodiments, a magnet may be embedded in clip 200 proximate to chamber 201 such that the magnet attaches the clip to magnetic members placed in chamber 201.

Clip 200 has an aperture 205. In some embodiments, as shown in FIG. 2C, the plane of aperture 205 is approximately parallel to the axis of opening 201. Aperture 205 has an opening 206, which may receive substantially planar items such as a towel (not shown). The planar item, such as a towel, may be inserted into opening 206 with or without the flexure of arms 207 and 208. The towel may be attached to clip 200 using a fastener.

Figure 3:
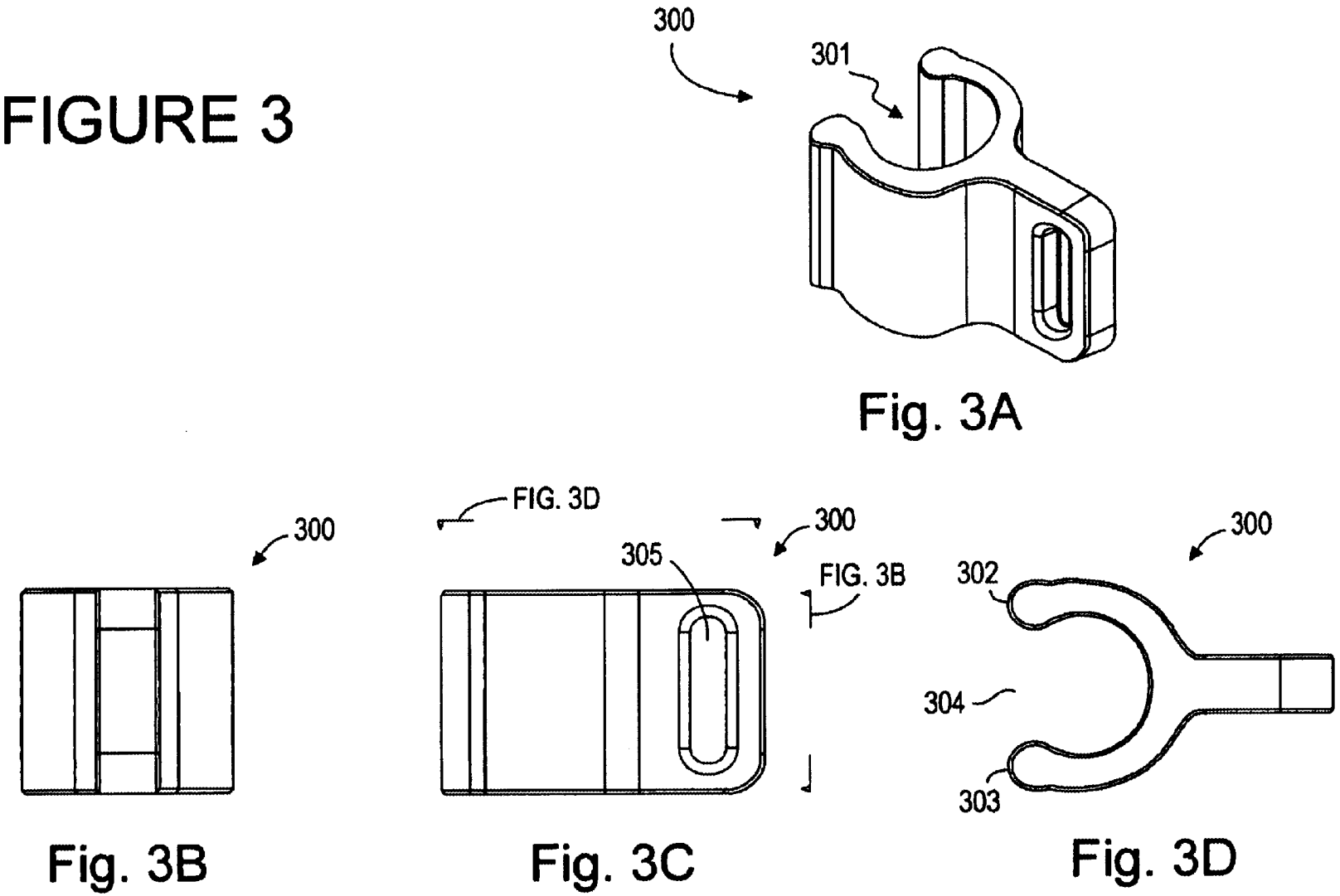
FIGS. 3A–D provide sketch views of a clip, in accordance with some embodiments of the present invention, wherein the aperture adapted to receive the towel is approximately perpendicular to the aperture adapted to receive the golf club.

In some embodiments, as shown in FIG. 3, aperture 305 is a through hole. Aperture 305 could be of any number of cross-sectional shapes. Clip 300 has two arms 302 and 303 joined together at one end and spaced apart at the other end to define an opening 304. Together arms 302 and 303 enclose an interior chamber 301. Clip 300 is designed to receive and hold in place a member (not shown) in chamber 301. In some embodiments, aperture 305 may receive an item such as a towel. In some embodiments, aperture 305 may receive a fastener which is used to attach an item such as a towel to clip 300.

Figure 4:
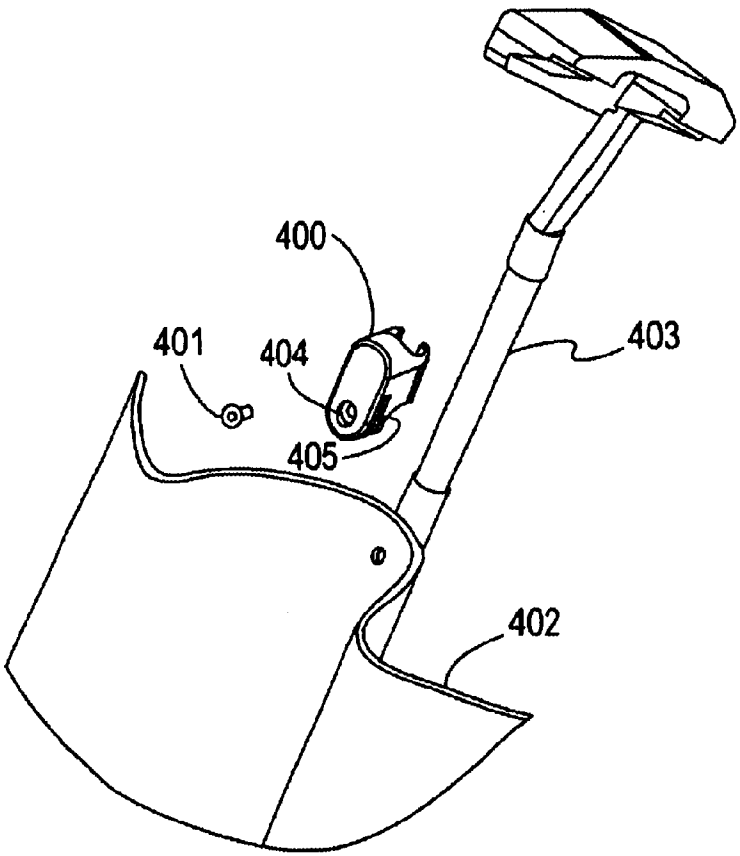
FIG. 4 shows an exploded view of a clip, in accordance with some embodiments of the present invention, wherein the towel is attached to the clip with a fastener.

In some embodiments, as shown in FIG. 4, towel 402 is attached to clip 400 with a fastener 401. Clip 400, in turn, is attached to a club shaft 403. Fastener 401 is inserted through opening 404 and protrudes at least partially into aperture 405. In some embodiments, fastener 401 may be a pop rivet, a threaded member, a strap, or other type of fastener. In some embodiments, fastener 401 is removably fastened.

Figure 5:
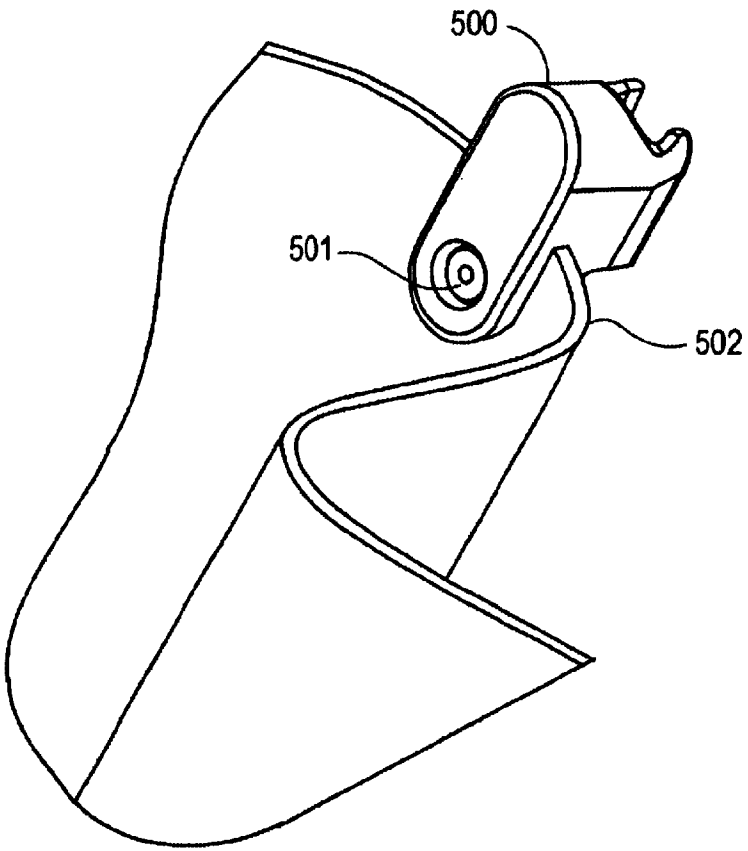
FIG. 5 shows a clip, in accordance with some embodiments of the present invention, wherein the towel is attached with a rivet.

In some embodiments, as shown in FIG. 5, towel 502 is attached to clip 500 with a rivet 501.

Figure 6:
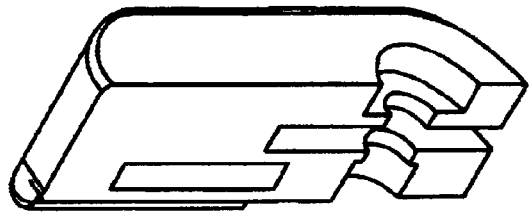
FIG. 6 shows a clip, in accordance with some embodiments of the present invention, in which a magnet is used.
Figure 6:
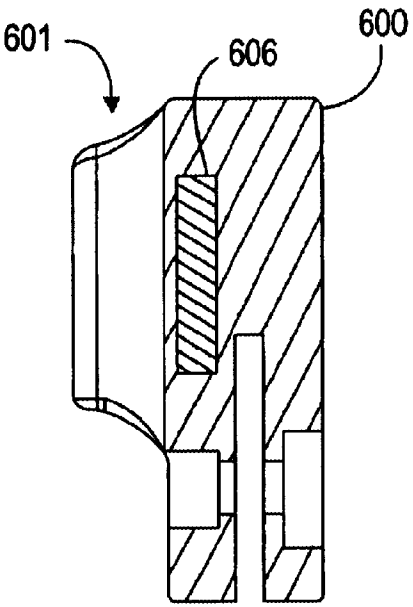

In some embodiments, as shown in FIG. 6, clip 600 contains a magnet 606. Magnet 606 is located proximate to an interior chamber 601. Magnet 606 may attach clip 600 to a metallic member.

As shown in FIG. 7A, a method 710 of attaching a towel to a golf club, in accordance with some embodiments of the present invention, comprises spreading bendable tongs (step 711) and inserting the golf club into the aperture (step 712).

As shown in FIG. 7C, a method 700 of manufacturing a clip in accordance with some embodiments of the present invention. Method 700 includes step 701, manufacturing an aperture to receive a portion of a golf club, and step 702, manufacturing a second aperture to allow for attachment of a towel. The clip may be manufactured by machining, plastic injection molding or other techniques known in the art. A towel is attached using a fastener thorough the second aperture (step 703).

A method 705 of manufacturing a clip in accordance with some embodiments of the present invention, shown in FIG. 7D. Method 705 includes step 706, manufacturing an aperture to receive a portion of a golf club, and step 707, manufacturing a second aperture to allow for attachment of a towel. A towel is inserted into the second aperture (step 708), and the towel is fastened with a fastener inserted at least partially through the second aperture (step 709).

A method 720 of attaching a towel to a golf club consisting of attaching the clip body to the golf club (step 721), as shown in FIG. 7B.

Embodiments described above illustrate, but do not limit the invention. In particular, the invention is not limited to any specific material or dimensions used for the clip. In addition, clips may be constructed by any processes known in the art, in accordance with the principles of the present invention. Other embodiments and varieties are within the scope of the invention, as defined by the following claims.

We claim:

1. A method for attaching a towel to a portion of a golf club, the method comprising:

attaching a clip body to a portion of a golf club, wherein said clip body has a first aperture adapted to receive a golf club and wherein said clip body has a towel attached to it.

2. The method of claim 1, wherein said portion of a golf club is a shaft.

3. The method of claim 1, wherein said attaching a clip body to a portion of a golf club comprises:

spreading bendable tongs surrounding said first aperture; and inserting said golf club into the first aperture.

4. The method of claim 1, wherein said attaching a clip body to a portion of a golf club comprises:

attaching the clip to the golf club with a magnet.

5. The method of claim 1, wherein said clip body has a second aperture adapted to receive said towel.

6. The method of claim 5, wherein said towel is attached to said clip body by a fastener that is adapted to be inserted at least partially through said second aperture.

7. The method of claim 6, wherein said fastener is removably fastened.

8. The method of claim 6, wherein said fastener is a rivet.

9. The method of claim 5, wherein said towel is inserted into said second aperture.

10. The method of claim 1, wherein said clip body further comprising bendable tongs surrounding said first aperture.

11. The method of claim 1, wherein at least a portion of said clip body is made of plastic.

12. A clip to attach a towel to a golf club, the clip comprising:

a body with a first aperture shaped to receive a portion of a golf club and a second aperture adapted to receive a towel; and a magnet proximately located to said first aperture to attach said clip to a portion of the golf club.

* * * * *